US008371811B2

(12) United States Patent
Eslinger

(10) Patent No.: US 8,371,811 B2
(45) Date of Patent: Feb. 12, 2013

(54) SYSTEM AND METHOD FOR IMPROVING FLOW IN PUMPING SYSTEMS

(75) Inventor: David Eslinger, Collinsville, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1443 days.

(21) Appl. No.: 11/866,966

(22) Filed: Oct. 3, 2007

(65) Prior Publication Data

US 2009/0092478 A1 Apr. 9, 2009

(51) Int. Cl.
*F04D 29/44* (2006.01)

(52) U.S. Cl. ..... 415/199.1; 415/211.2; 416/186 R; 416/223 B; 416/DIG. 2

(58) Field of Classification Search .... 415/199.1–199.3, 415/211.1, 211.2, 208.2, 208.3, 209.1; 416/185, 416/186 R, 223 B, DIG. 2
See application file for complete search history.

(56) References Cited

U.S. PATENT DOCUMENTS

| | | | | |
|---|---|---|---|---|
| 4,307,995 | A * | 12/1981 | Catterfeld | 415/199.1 |
| 4,741,668 | A * | 5/1988 | Bearden | 415/199.1 |
| 5,207,560 | A * | 5/1993 | Urban | 415/199.1 |
| 5,207,810 | A | 5/1993 | Sheth | |
| 5,344,285 | A * | 9/1994 | O'Sullivan et al. | 415/199.2 |
| 6,394,183 | B1 | 5/2002 | Schrenkel et al. | |
| 6,398,493 | B1 * | 6/2002 | Chien et al. | 415/199.2 |
| 6,564,874 | B2 | 5/2003 | Narvaez | |
| 6,723,158 | B2 | 4/2004 | Brown et al. | |
| 6,779,965 | B2 | 8/2004 | Pessin et al. | |
| 6,811,382 | B2 | 11/2004 | Buchanan et al. | |
| 6,971,848 | B2 | 12/2005 | Watson | |
| 6,974,246 | B2 | 12/2005 | Arribau et al. | |
| 6,979,174 | B2 | 12/2005 | Watson et al. | |
| 7,133,325 | B2 | 11/2006 | Kotsonis et al. | |
| 2005/0074330 | A1 * | 4/2005 | Watson et al. | 415/199.2 |
| 2007/0116560 | A1 | 5/2007 | Eslinger | |

FOREIGN PATENT DOCUMENTS

JP 05071490 A * 3/1993

* cited by examiner

*Primary Examiner* — Igor Kershteyn
*Assistant Examiner* — Jesse Prager
(74) *Attorney, Agent, or Firm* — Jim Patterson

(57) ABSTRACT

A technique is provided for improving the efficiency of a centrifugal pump. The centrifugal pump comprises diffusers that optimize the area schedule through the diffuser to diffuse the total fluid velocity and recover dynamic head while minimizing flow separation. Each diffuser comprises an improved transition from the diffuser blade into the diffuser discharge duct to remove abrupt changes in area and to reduce fluid separation. The impellers also can be constructed with impeller transitions able to reduce fluid separation and improve the efficiency of the pump.

25 Claims, 4 Drawing Sheets

SYSTEM AND METHOD FOR IMPROVING FLOW IN PUMPING SYSTEMS

BACKGROUND

Centrifugal pumps are used in a wide variety of applications, including well related applications. For example, centrifugal pumps are used in electric submersible pumping systems deployed in wellbores to produce or otherwise move fluids in the wellbore. Centrifugal pumps are constructed with stacks of alternating impellers and diffusers that cause fluid to flow from an inlet of the pump to an outlet. The impellers are rotated by a shaft and impart motion to the pumped fluid via pump impeller vanes. As fluid passes from each impeller flow passage, the fluid is routed through a diffuser passage to the next impeller and ultimately to the outlet.

Many centrifugal pump designs have inefficiencies due to significant fluid separation losses. For example, centrifugal pumps with radial vane configurations suffer from excessive diffusion in the ducts connecting vaned passages. Excessive diffusion can occur in the flow passages between the diffuser blades or impeller blades, but the excessive diffusion also can occur in the transition region from the trailing edge of the diffuser to the duct leading to the exit of the diffuser. Another location susceptible to excessive diffusion is the transition region from the entrance of the impeller inlet duct to the leading edge of the impeller blade.

In some radial type stages, the trailing edge of the diffuser blade has been formed as a thick, blunt member to control excessive diffusion within the diffuser flow passage, however this approach leads to large amounts of diffusion and separation losses in the duct just downstream of the diffuser trailing edge. An alternative approach has been to form the trailing edge of the diffuser as a relatively thin member to minimize the area change at the duct transition, however this approach leads to excessive diffusion of the flow in the diffuser passage.

SUMMARY

In general, the present invention provides a system and method for improving the efficiency of a centrifugal pump. The centrifugal pump comprises diffusers that optimize the area schedule through the diffuser to diffuse the total fluid velocity and recover dynamic head while minimizing flow separation. Each diffuser comprises at least one diffuser blade having a trailing edge that extends through at least thirty degrees into a diffuser discharge duct. The transition into the diffuser discharge duct removes any abrupt changes in area and reduces fluid separation which, in turn, improves the efficiency of the pump. In some embodiments, each impeller comprises at least one impeller blade that extends through at least thirty degrees into an impeller inlet duct. This impeller transition also reduces fluid separation and improves the efficiency of the pump.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a centrifugal pump that can be utilized in a variety of applications. The centrifugal pump is constructed with diffusers and/or impellers that are less susceptible to excessive diffusion and the resultant fluid separation. By way of example, the centrifugal pump may be in the form of a submersible pump used in well related applications. For example, the centrifugal pump can be employed in an electric submersible pumping system used to pump fluids within a wellbore. The unique design of the pump diffusers and/or impellers reduces fluid separation losses and improves the efficiency of the centrifugal pump in submersible and other applications.

Figure 1:
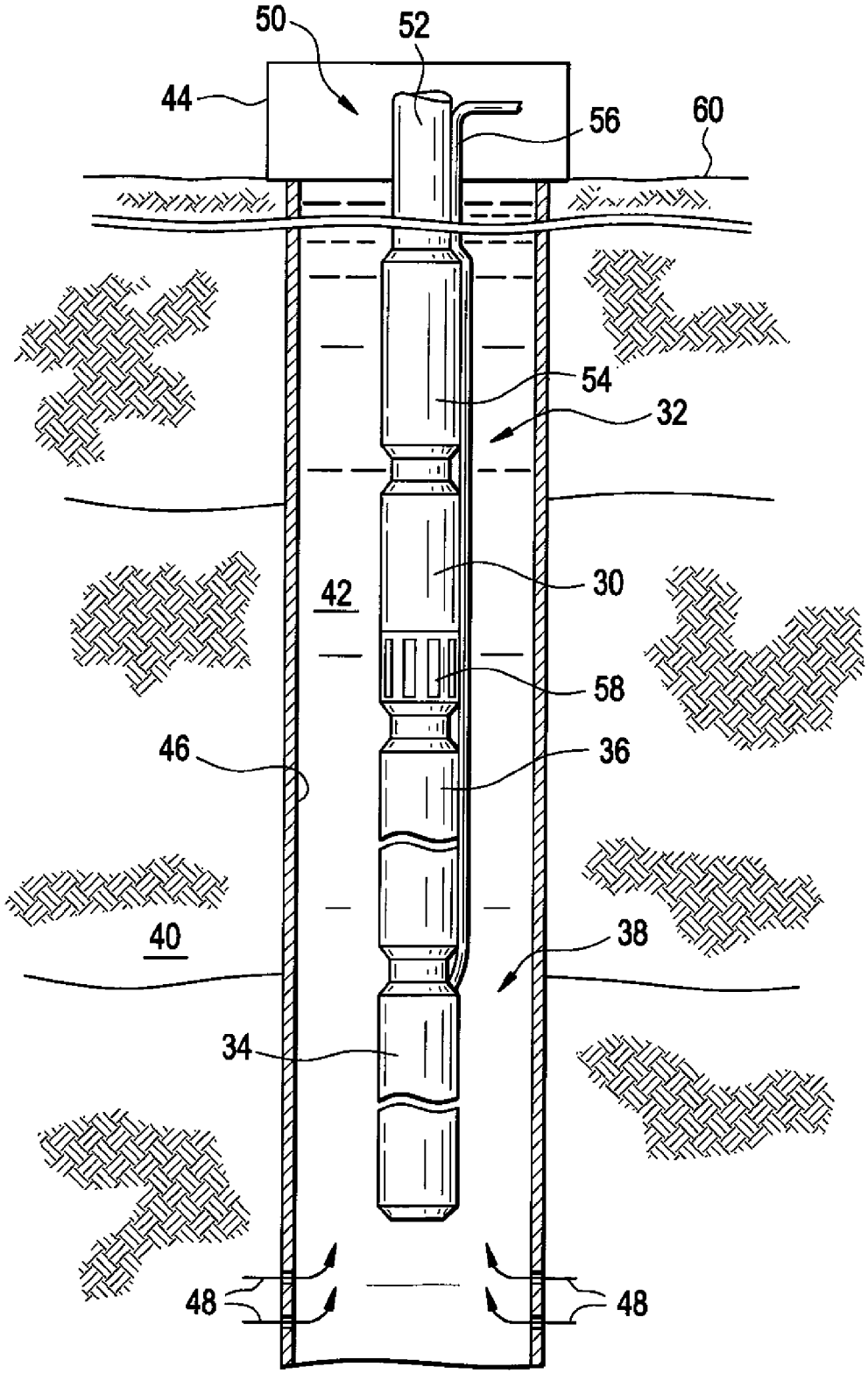
FIG. 1 is a front elevation view of a well system having a centrifugal pump deployed in a wellbore, according to an embodiment of the present invention.

An example of a centrifugal pump 30 deployed in a well related application is illustrated in FIG. 1. However, the illustrated embodiment is only one example of numerous applications and systems that benefit from the improved design of centrifugal pump 30. Referring again to FIG. 1, centrifugal pump 30 is illustrated as deployed in a submersible pumping system 32, e.g. an electric submersible pumping system. Submersible pumping system 32 may comprise a variety of components depending on the particular well application or environment in which it is used. Examples of components utilized in addition to centrifugal pump 30 are at least one submersible motor 34 and one or more motor protectors 36 connected together to form the submersible pumping system.

In the embodiment illustrated, submersible pumping system 32 is designed for deployment in a well 38 within a geological formation 40 that may contain desirable production fluids, such as hydrocarbon based fluids. Formation 40 may be accessed by a wellbore 42 that is drilled into formation 40 and extends downwardly from a wellhead 44. The wellbore 42 may be lined by a wellbore casing 46 which is perforated with a plurality of perforations 48 to enable flow of fluids between the surrounding formation 40 and the wellbore 42.

Submersible pumping system 32 is deployed in wellbore 42 by a conveyance system 50 that may have a variety of configurations. For example, conveyance system 50 may comprise a tubing 52, e.g. coiled tubing or production tubing, connected to the submersible pumping system 32 through an appropriate connector 54. Power is provided to the at least one submersible motor 34 via a power cable 56 that extends downwardly along conveyance system 50 and submersible pumping system 32 for connection with submersible motor 34. The submersible motor 34, in turn, powers centrifugal pump 30 which can be used to draw in fluid through a pump intake 58. Within centrifugal pump 30, a plurality of impellers is rotated to pump, e.g. produce, fluid through tubing 52 to a desired location, such as a collection location at a surface 60 of the earth. However, a variety of other components and system configurations can be utilized for performance of many types of pumping operations.

Figure 2:
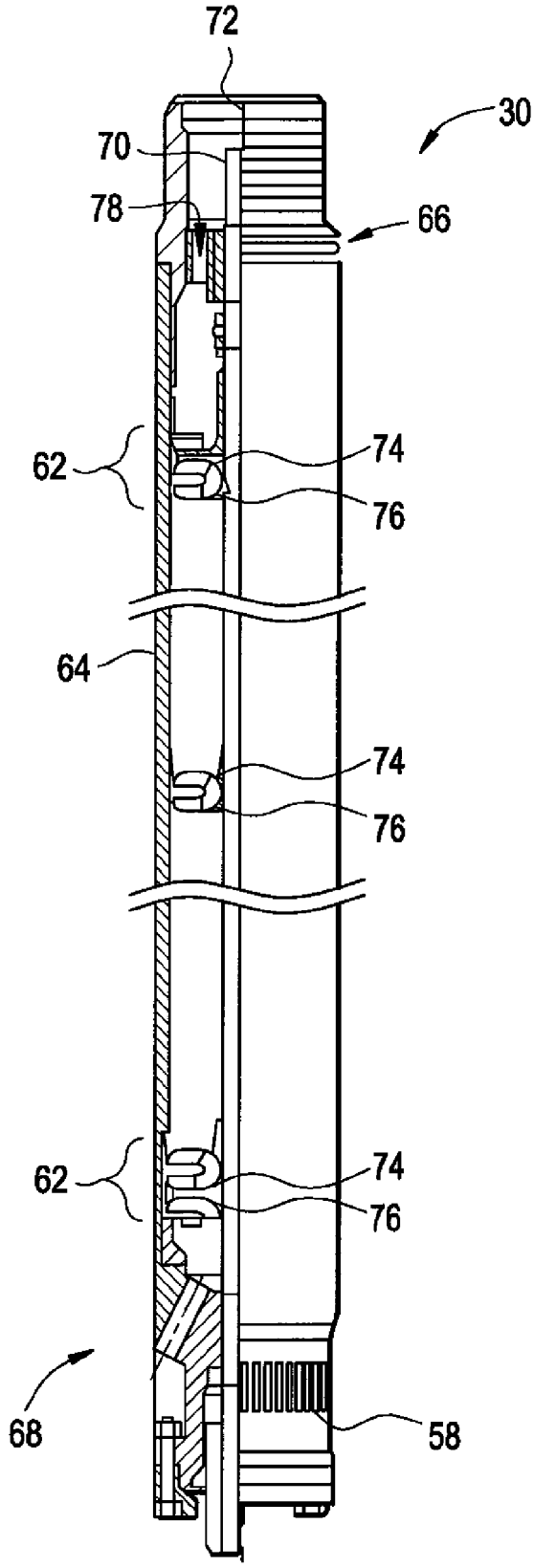
FIG. 2 is a partial cross-section of the centrifugal pump illustrated in the well system of FIG. 1, according to an embodiment of the present invention.

Referring generally to FIG. 2, one embodiment of centrifugal pump 30 is illustrated as having a plurality of pump stages 62 distributed along a substantial portion of its length. In FIG. 2, only a few of the stages 62 are illustrated to facilitate explanation. Centrifugal pump 30 also comprises an outer housing 64 that may be tubular in shape and extends between a first pump end 66 and a second pump end 68. A shaft 70 is rotatably mounted within the outer housing 64 generally along an axis 72 of centrifugal pump 30.

Each pump stage 62 comprises a diffuser 74 and an impeller 76. In this embodiment, centrifugal pump 30 is a radial style pump having radial style impellers and diffusers. (Radial style impellers and diffusers are constructed so the major direction of fluid flow is a substantially radial flow direction relative to the pump axis of rotation.) Generally, impellers 76 rotate with shaft 70 and may be rotationally affixed to shaft 70 by, for example, a key and key way. The rotating impellers 76 impart motion to fluid flowing through centrifugal pump 30 and move the fluid from one stage 62 to the next until the fluid is discharged through outlet flow passages 78 at first pump end 66. The diffusers 74 are rotationally stationary within outer housing 64 and serve to guide the fluid from one impeller 76 to the next.

Figure 3:
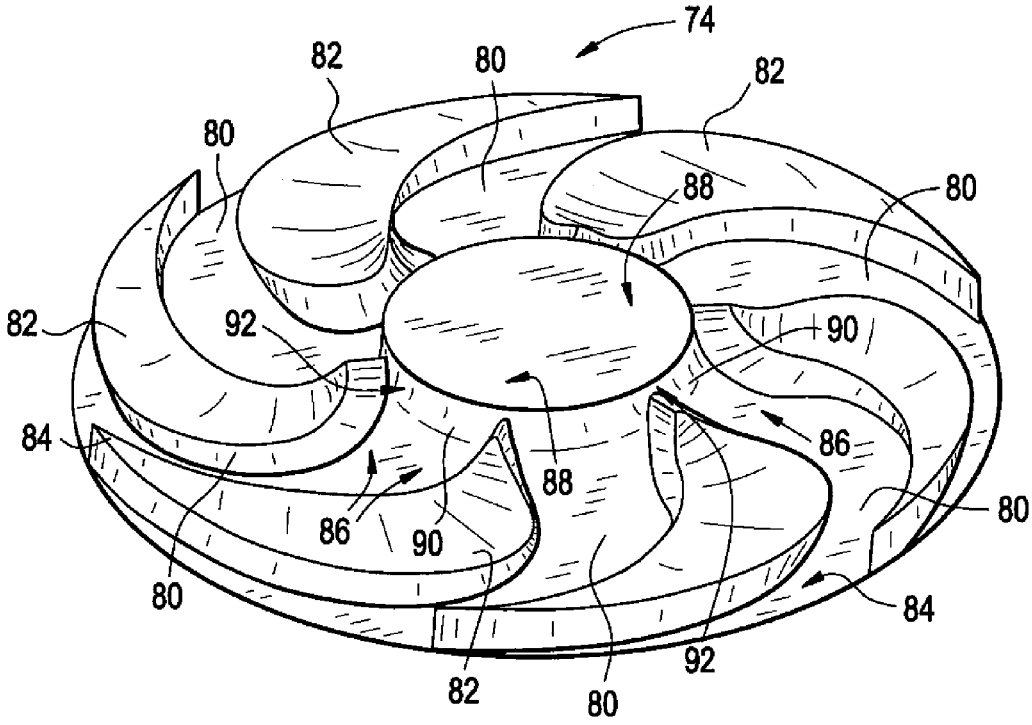
FIG. 3 is a schematic illustration of a diffuser for use in the centrifugal pump, according to an embodiment of the present invention.

In FIG. 3, one embodiment of diffuser 74 is schematically illustrated as constructed in a manner that prevents excessive diffusion and the resultant fluid separation that otherwise would create substantial pump losses. As illustrated, diffuser 74 comprises a diffuser passage 80, and typically a plurality of diffuser passages 80. Each diffuser passage 80 is defined at least in part by vanes or blades 82 that create the passage therebetween. Additionally, each diffuser blade 82 comprises a leading edge 84 that receives fluid from a next adjacent impeller 76. The flowing fluid moves along the diffuser passage 80 to a trailing edge 86 and then into a diffuser discharge duct region 88 (disposed generally above trailing edge 86 in FIG. 3).

The diffuser blade trailing edge 86 defines a diffuser passage trailing edge transition 90 that turns or arcs toward the diffuser discharge duct 88. The design of diffuser passage trailing edge transition 90 creates a shape that results in minimal change in area moving from trailing edge 86 of diffuser blade 82 to the diffuser discharge duct 88. This eliminates excessive diffusion and the consequent fluid separation as fluid flows through trailing edge transition 90 and into diffuser discharge duct 88. Additionally, each diffuser blade 82 is designed to provide a controlled diffusion as fluid flows through the passage. Accordingly, diffuser 74 is able to diffuse the total fluid velocity and recover dynamic head while minimizing flow separation.

Figure 4:
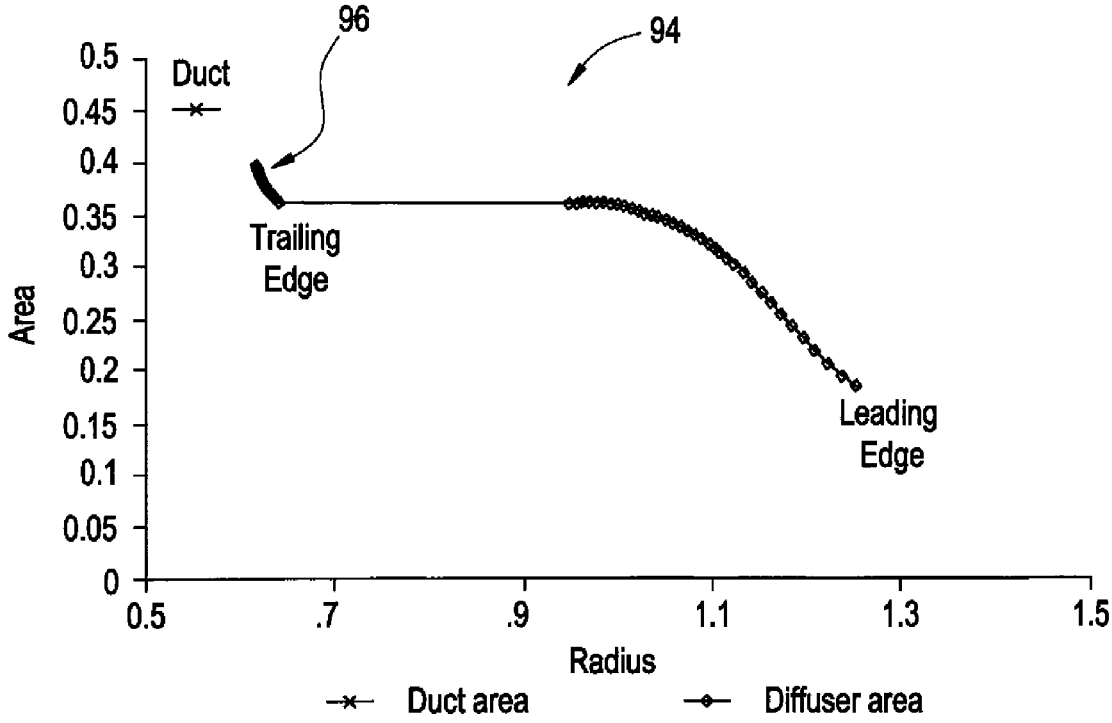
FIG. 4 is a graph illustrating the area schedule for the diffuser illustrated in FIG. 3, according to an embodiment of the present invention.

Diffuser passage trailing edge transition 90 of trailing edge 86 is formed with an arc region 92 that enables each diffuser passage 80 to arc or turn toward the diffuser discharge duct 88 to eliminate any substantial change in area. As shown by an area schedule 94, illustrated graphically in FIG. 4, minimal or no change in area occurs as the trailing edge transition 90 of each diffuser passage 80 transitions to the inlet of the corresponding diffuser discharge duct 88. The transition region and the lack of any substantial change in area is illustrated at point 96 of area schedule 94. As a result, relatively little diffusion occurs as fluid flows from the trailing edge 86 of each diffuser blade 82 into the adjacent diffuser discharge duct 88, thereby improving the pumping efficiency.

As described above, the reduction of excessive diffusion and resultant fluid separation can be achieved by constructing diffusers 74 with trailing edges that arc/turn to the diffuser discharge duct 88 so as to reduce area change in this transition region. A desired reduction in fluid separation can be achieved by constructing each diffuser 74 so the trailing edge 86 of each diffuser blade 82 arcs or otherwise extends through at least thirty degrees into the corresponding diffuser discharge duct 88, as indicated by angle 98 in FIG. 5. In other embodiments and depending on the configuration of diffuser blades 82, the potential for fluid separation can further be reduced by extending the trailing edge 86 along an arc through at least sixty degrees into the corresponding diffuser discharge duct 88, as indicated by angle 100. Furthermore, some embodiments of diffuser 74 are able to gain substantial, and in some cases nearly complete, reduction of fluid separation by forming the arc of trailing edge 86 through approximately ninety degrees into the corresponding diffuser discharge duct 88, as indicated by angle 102. By way of example, the diffuser 74 illustrated in FIG. 3 utilizes a transition 90 in which the trailing edge 86 extends through approximately ninety degrees to the inlet of diffuser discharge duct 88.

Figure 5:
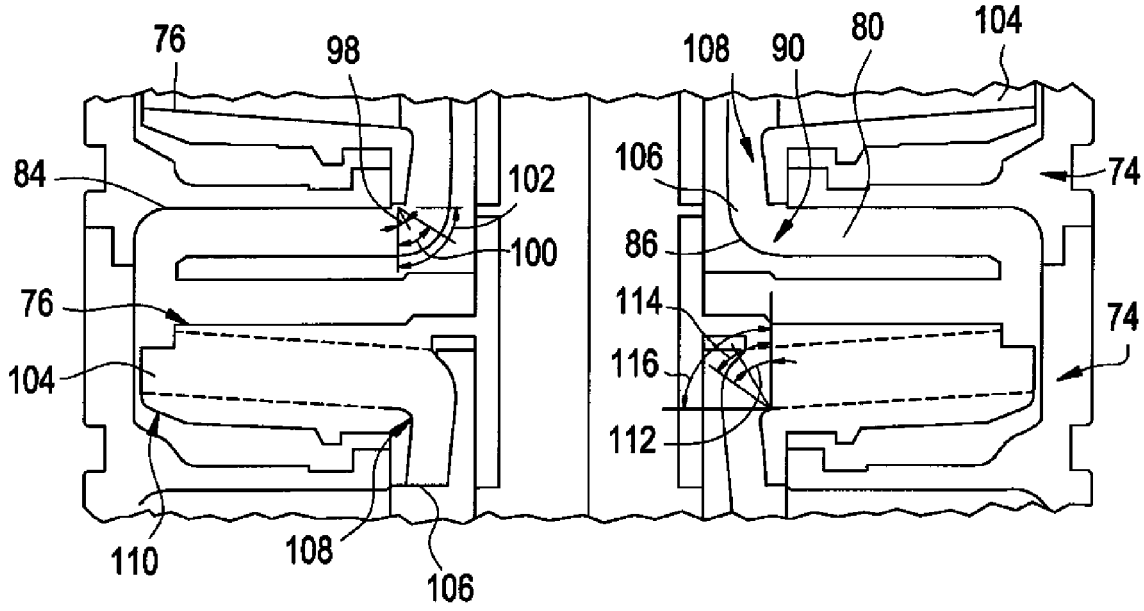
FIG. 5 is a cross-sectional view of a portion of the centrifugal pump, according to an embodiment of the present invention.
Figure 6:
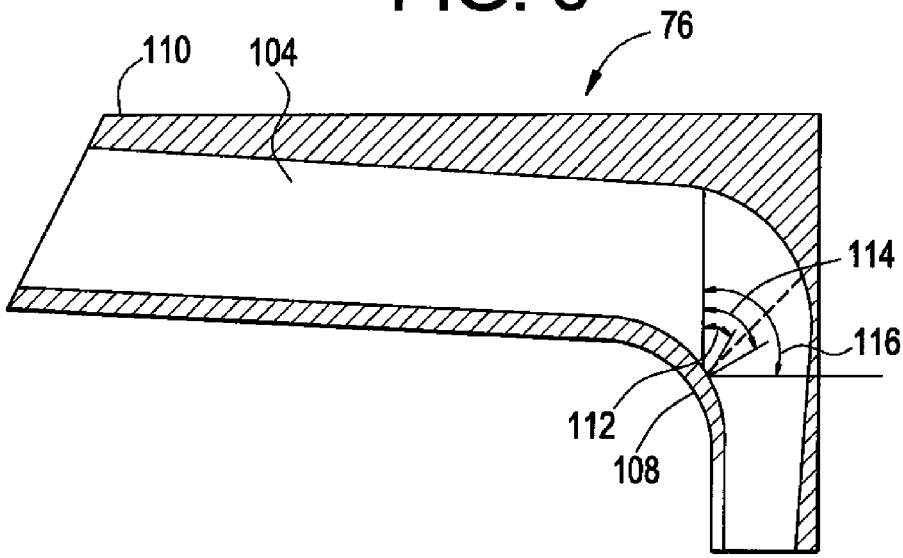
FIG. 6 is an enlarged cross-sectional view of a single flow passage of an impeller, according to an embodiment of the present invention.

With reference to FIGS. 5 and 6, excessive diffusion and the resultant fluid separation also can be reduced through similar construction techniques applied to the impellers 76. In many traditional impeller designs, a substantial area increase, e.g. 60 percent or more, occurs from the impeller inlet duct to the leading edge of the impeller vane. This large area increase often leads to significant fluid separation losses. As illustrated, each impeller 76 comprises one or more impeller vanes or blades 104 that direct fluid flow from an impeller inlet duct 106 to a next adjacent diffuser 74.

Each impeller blade 104 comprises a leading edge 108 through which fluid is received and a trailing edge 110 along which fluid is discharged to the next adjacent diffuser. In the embodiment illustrated, the leading edge 108 of impeller blade 104 is designed to transition along an arc toward impeller inlet duct 106. This ensures a much smaller area increase from the impeller inlet duct 106 into the leading edge 108 of each impeller blade. As with diffuser 74, significant reductions in fluid separation can be achieved by constructing each impeller 76 so the leading edge 108 of each impeller blade 104 arcs or otherwise extends through at least thirty degrees into the corresponding impeller inlet duct 102, as indicated by angle 112 in FIGS. 5 and 6. In other applications, the potential for fluid separation can further be reduced by extending the leading edge 108 along an arc through at least sixty degrees into the corresponding impeller inlet duct 106, as indicated by angle 114. Furthermore, some embodiments of impeller 76 can further reduce the potential for fluid separation by forming the arc of leading edge 108 through approximately ninety degrees into the corresponding impeller inlet duct 106, as indicated by angle 116. It should be noted the diffusers 74 and impellers 76 illustrated in FIG. 5 are radial style diffusers and impellers that can be deployed within outer housing 64 of centrifugal pump 30.

The design of diffusers 74 and/or impellers 76 reduces excessive diffusion in pump regions that otherwise would incur fluid separation and resultant losses in pump efficiency. However, the specific size, construction, materials, and configuration of both the diffusers and impellers can be adjusted according to the design of the overall pumping system, the fluid pumped, the environment in which the pumping system is utilized, and other design parameters. Furthermore, the more efficient centrifugal pump can be used in a variety of pumping systems, such as electric submersible pumping systems, and in a variety of applications.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A device, comprising:

a centrifugal pump comprising:

a plurality of impellers; and a plurality of diffusers, each diffuser being a radial style diffuser with a plurality of diffuser blades having trailing edges that arc through a transition of at least thirty degrees into corresponding diffuser discharge ducts, the plurality of diffuser blades creating diffuser passages which extend through the transition and into the corresponding diffuser discharge ducts with minimal change in area to thus reduce fluid separation.

2. The device as recited in claim 1, wherein the trailing edges arc through approximately ninety degrees into the corresponding diffuser discharge ducts.

3. The device as recited in claim 1, wherein each impeller comprises a plurality of impeller blades that arc through at least thirty degrees into corresponding impeller inlet ducts.

4. The device as recited in claim 3, wherein the impeller blades arc through approximately ninety degrees into the corresponding impeller inlet ducts.

5. A method of reducing flow separation in a centrifugal pump, comprising:

forming a plurality of radial style diffusers with each diffuser having blades with trailing edges that arc through at least thirty degrees into corresponding diffuser discharge ducts;

maintaining a constant flow area between the blades and into the corresponding diffuser discharge ducts; and assembling the plurality of diffusers with a plurality of impellers into the centrifugal pump.

6. The method as recited in claim 5, wherein forming comprises forming each diffuser with the trailing edges arcing through at least sixty degrees into the corresponding diffuser discharge ducts.

7. The method as recited in claim 5, wherein forming comprises forming each diffuser with the trailing edges arcing through approximately ninety degrees into the corresponding diffuser discharge ducts.

8. A method of reducing flow separation in a centrifugal pump, comprising:

forming a plurality of radial style impellers with each impeller having a plurality of impeller blades arcing through at least thirty degrees into corresponding impeller inlet ducts;

maintaining a constant flow area between the impeller blades and into the corresponding impeller inlet ducts; and assembling the plurality of impellers with a plurality of diffusers into the centrifugal pump.

9. The method as recited in claim 8, further comprising constructing each impeller with impeller blades arcing through at least sixty degrees into corresponding impeller inlet ducts.

10. The method as recited in claim 8, further comprising constructing each impeller with impeller blades arcing through approximately ninety degrees into corresponding impeller inlet ducts.

11. A system, comprising:

a submersible motor; and a submersible pump driven by the submersible motor, the submersible pump comprising radial style diffusers that each have diffuser blades with trailing edges arcing through a transition of at least thirty degrees into corresponding diffuser discharge ducts, the diffuser blades creating diffuser passages which extend through the transition and into the corresponding diffuser discharge ducts with minimal change in area to thus reduce fluid separation.

12. The system as recited in claim 11, wherein each diffuser has diffuser blades with trailing edges that arc through at least sixty degrees into corresponding diffuser discharge ducts.

13. The system as recited in claim 11, wherein each diffuser has diffuser blades with trailing edges that arc through approximately ninety degrees into corresponding diffuser discharge ducts.

14. The system as recited in claim 11, wherein the submersible pump comprises impellers that each have impeller blades arcing through approximately ninety degrees into corresponding impeller inlet ducts.

15. The system as recited in claim 11, further comprising a motor protector deployed between the submersible motor and the submersible pump.

16. The system as recited in claim 11, wherein a flow area at an exit of each trailing edge is substantially the same as the flow area at an entry to the corresponding diffuser discharge duct.

17. A device, comprising:

a centrifugal pump comprising:

a plurality of impellers, each impeller being a radial style impeller with a plurality of impeller blades that arc through at least thirty degrees into corresponding impeller inlet ducts without any substantial change in flow area such that the flow area design reduces diffusion and fluid separation; and a plurality of diffusers.

18. The device as recited in claim 17, wherein each diffuser comprises a plurality of diffuser blades that arc through at least sixty degrees into corresponding impeller inlet ducts.

19. The device as recited in claim 17, wherein each impeller comprises a plurality of impeller blades that arc through at least thirty degrees into corresponding impeller inlet ducts.

20. The method as recited in claim 5, comprising:

forming each diffuser with a plurality of diffuser blades that define flow areas at exits of diffuser blade trailing edges, each flow area being substantially the same as the flow area at an entry of a corresponding diffuser discharge duct.

21. The method as recited in claim 20, wherein forming comprises forming each diffuser blade trailing edge such that it arcs through at least thirty degrees.

22. The device of claim 17, wherein the impeller blades arc through at least ninety degrees into corresponding impeller inlet ducts.

23. The method as recited in claim 20, wherein forming comprises forming each diffuser blade trailing edge such that it arcs through approximately ninety degrees.

24. The method as recited in claim 20, further comprising locating a plurality of radial style impellers between the plurality of diffusers, and creating each impeller with impeller blades arcing through at least thirty degrees into corresponding impeller inlet ducts.

25. The method as recited in claim 24, wherein creating comprises creating each impeller with impeller blades arcing through at least sixty degrees into the corresponding impeller inlet ducts.

* * * * *